US007210261B2

(12) United States Patent
Arachequesne

(10) Patent No.: US 7,210,261 B2
(45) Date of Patent: May 1, 2007

(54) MOUNTING A SIGHT DEVICE ON A SHOULDER AUTOMATIC OR SEMI-AUTOMATIC FIRE ARM

(75) Inventor: Patrick Arachequesne, Miserey (FR)

(73) Assignee: Sarl Patrick Arachequesne, Miserey (FR)

( * ) Notice: Subject to any disclaimer, the term of this patent is extended or adjusted under 35 U.S.C. 154(b) by 0 days.

(21) Appl. No.: 11/339,172

(22) Filed: Jan. 25, 2006

(65) Prior Publication Data

US 2006/0265928 A1 Nov. 30, 2006

(30) Foreign Application Priority Data

Jan. 27, 2005 (FR) ..... 05 00847

(51) Int. Cl.
*F41G 1/02* (2006.01)
*F41G 1/46* (2006.01)

(52) U.S. Cl. ..... 42/111; 42/141; 42/148; D22/110

(58) Field of Classification Search ..... 42/111, 42/130, 141, 142; D22/108–110
See application file for complete search history.

(56) References Cited

U.S. PATENT DOCUMENTS 2,433,909 A * 1/1948 Jeffries ..... 42/141
D151,408 S * 10/1948 Richards ..... D22/109
2,939,217 A * 6/1960 Hajek ..... 42/148
2,970,380 A * 2/1961 Hill ..... 42/141
3,133,353 A * 5/1964 Williams ..... 42/141
3,260,008 A * 7/1966 Yeomans, Jr. ..... 42/111
3,513,581 A 5/1970 Slater
3,861,050 A * 1/1975 Mauro ..... 42/111
3,886,667 A * 6/1975 Rueb ..... 42/141
4,006,531 A * 2/1977 Kwako ..... 42/141
4,790,075 A * 12/1988 Howard, Sr. ..... 42/130
5,092,071 A 3/1992 Moore
5,595,011 A 1/1997 Gorslin
6,804,908 B1 * 10/2004 Hanson et al. ..... 42/148
2004/0045209 A1 3/2004 Nielsen

* cited by examiner

*Primary Examiner*—Stephen M. Johnson
*Assistant Examiner*—Bret Hayes
(74) *Attorney, Agent, or Firm*—Pearne & Gordon LLP

(57) ABSTRACT

Mounting of a sight on a firearm semi-automatic or automatic shotgun of the type comprising a housing through which a screw extends which receives a threaded securing cap which is notched to cooperate with an elastic stub at one end of the housing, said mounting being characterized in that it comprises a support having a ring at one end designed to engage with the screw and comprising, on the one hand, a hole designed to receive the elastic stub and, on the other hand, a second elastic stub designed to cooperate with the notches, said ring being connected by a tab with a small plate that is folded over to extend above the barrel, means being provided to secure the sight onto the small plate.

14 Claims, 2 Drawing Sheets

MOUNTING A SIGHT DEVICE ON A SHOULDER AUTOMATIC OR SEMI-AUTOMATIC FIRE ARM

The present invention relates to the mounting of a sight on a firearm such as a semi-automatic or automatic hunting rifle.

A sighting system is understood to mean laser viewfinders, telescopic sights or holographic devices.

These kinds of firearms comprise a strip into which a magazine extends for holding the ammunition and which ends in a screw onto which a cap can be screwed, said cap having means to prevent accidental unscrewing.

On said firearms in order to mount a sight it is necessary to secure means for the attachment of the sight onto the barrel which is a painstaking and costly procedure.

The aim of the present invention is to provide a way of mounting which does not require any modification to the firearm.

The invention relates to the mounting of a sight on an automatic or semiautomatic shotgun of the type comprising a butt, a breech box, a barrel, a magazine housed in a housing and with a screw at the end designed to receive a threaded securing cap with a notched collar designed to cooperate with an elastic stub at the end of the housing, said mounting being characterised in that it comprises a support having at one end a ring designed to be engaged onto the screw and comprising, on the one hand, a hole designed to receive the elastic stub, and on the other hand a second elastic stub designed to cooperate with the notches of the collar, said ring being in one piece with a tab terminated by a small plate which is folded over to extend above the barrel, means being provided for securing the sight onto the small plate.

Thus to mount the sight onto a firearm of this type it is necessary to unscrew the cap and engage the ring onto the screw ensuring a good angular adjustment so that the elastic stub is inserted into the hole then the cap is retightened.

According to a structural characteristic the support is made from a metal plate that is cut out to have a ring at one end and the small plate at the other end, these two elements being connected by a tab which is folded so as to extend perpendicular to the ring, said small plate being folded perpendicular to the tab so that the ring and the small plate extend in two perpendicular planes.

The present invention is described in more detail in the following with reference to a particular embodiment which is given by way of example only and is shown in the attached drawings.

Figure 1:
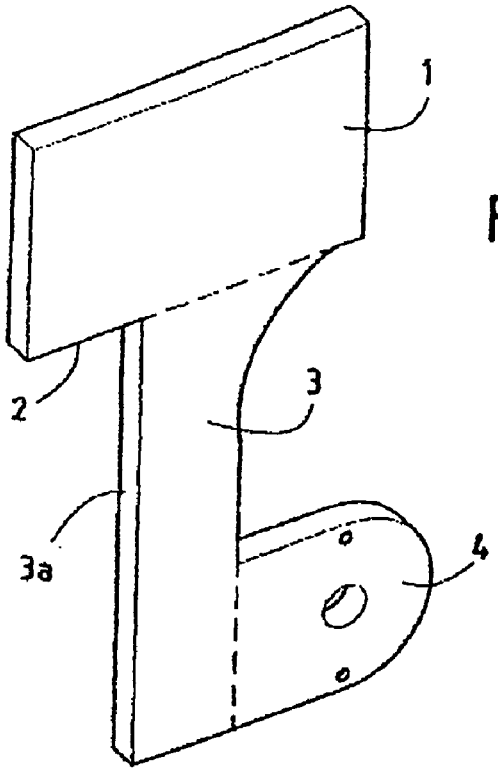
FIG. 1 is a plan view of a metal blank cut out to form the support.

FIG. 1 shows a plan view of a metal plate cut out to form an almost rectangular section 1, one long side 2 of which is connected by a tab 3 to a ring 4.

The ring 4 is provided on one face 4*a* with a hole 5 and on the face 4*b* with a flexible stub 6, the latter being mounted by sliding into a bore closed from the side of the face 4*a* by a screw 8.

The flexible stub 6 has a shoulder 9 cooperating with a shoulder of the bore, a compression spring 11 being inserted between the screw 8 and the stub.

Figure 3:
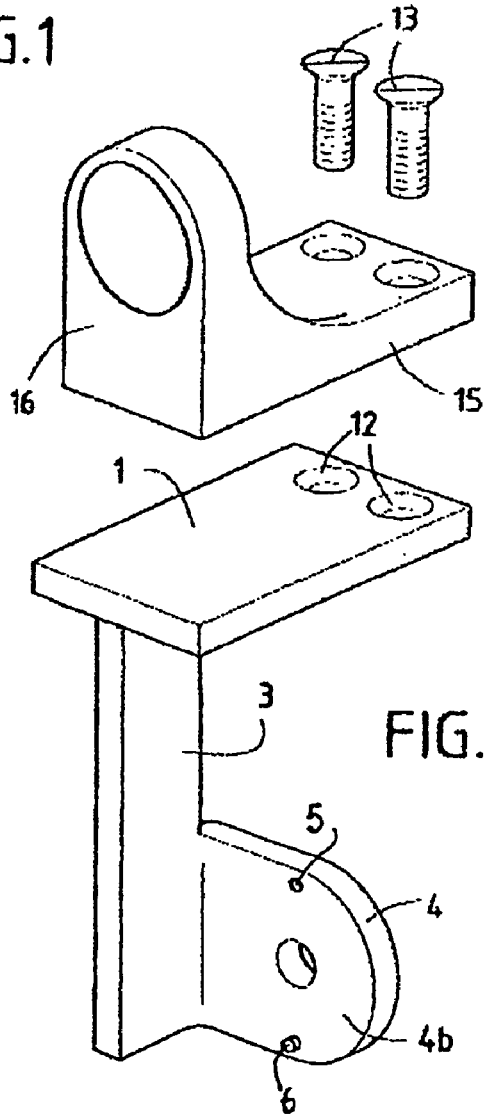
FIG. 3 is a perspective view of the support.
Figure 2:
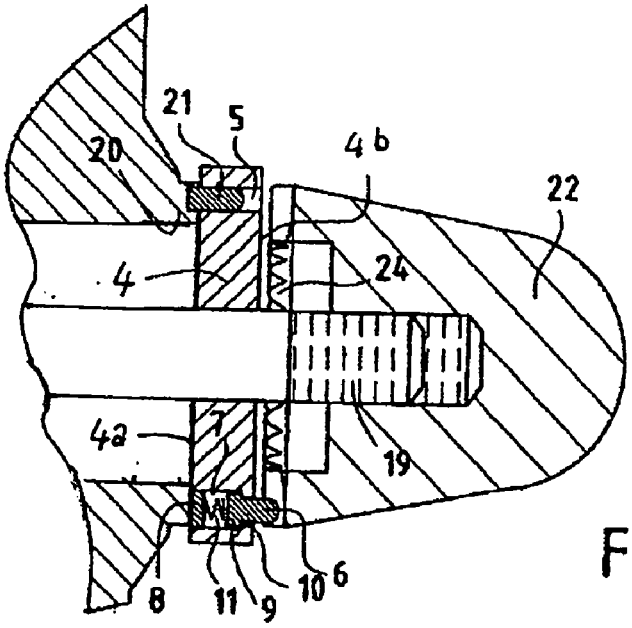
FIG. 2 is a cross section showing the mounting of the support.

As shown in FIG. 3 the rectangular section 1 is folded over to extend perpendicular to the tab 3, whilst the edge 3*a* of the tab 3 is folded perpendicular to the ring 4. In this way section 1 and the ring 4 extend in two perpendicular planes.

The rectangular section 1 constitutes the small plate and has tapped holes 12 making it possible to secure the base 15 of a holographic sight 16 using screws 13.

A holographic device is shown by way of example, but a different device could be mounted on section 1, for example a telescopic or a laser device.

Figure 4:
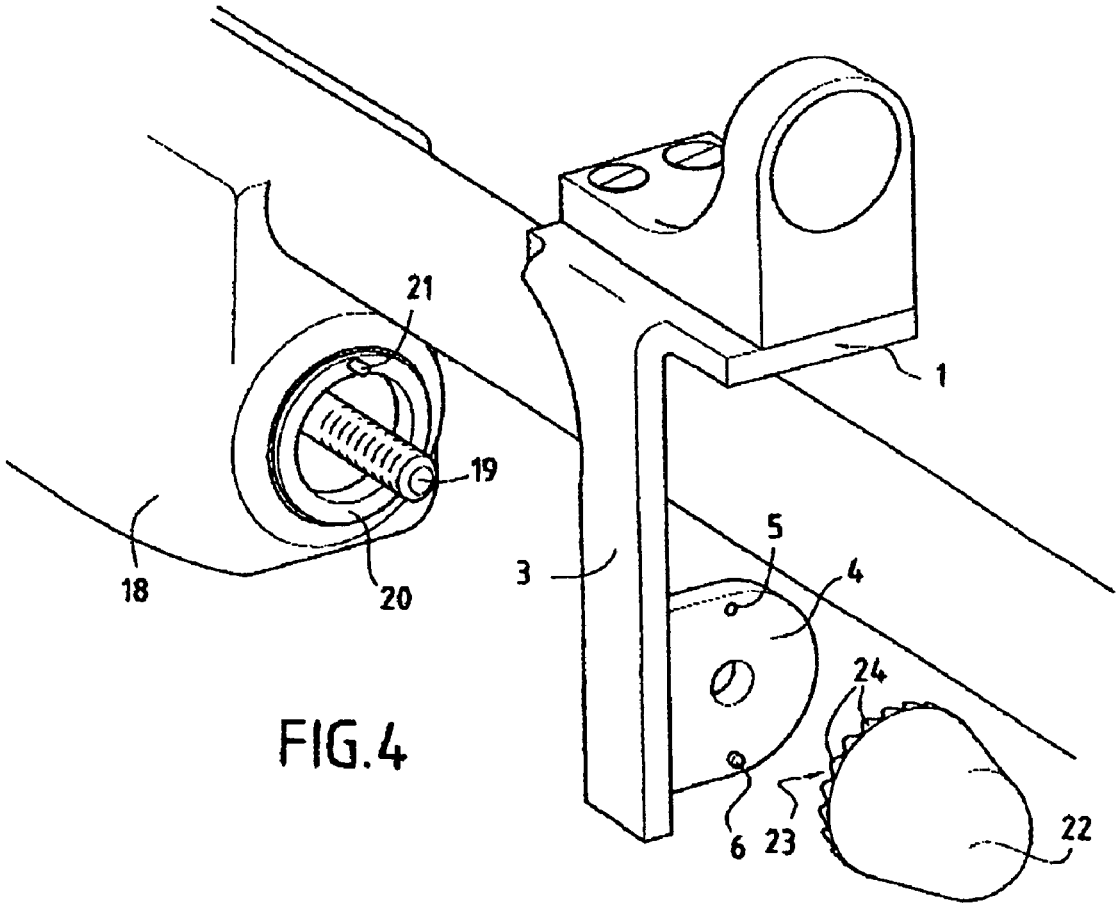
FIG. 4 is an exploded perspective view showing the mounting.

FIG. 4 shows the housing 18 of a semiautomatic rifle in which there is a magazine with a screw 19 at the end, the latter projecting at the free end of the housing 18 which comprises a metal ring 20 provided with a resilient stub 21.

Normally, a cap 22 with a collar 23 provided with notches 24 is screwed onto the screw 19. The stub moves aside partly elastically when the cap 22 is screwed on and acts as a check by cooperating with the notches to prevent the accidental loosening of the cap.

According to the invention a ring 4 is placed onto the screw 19 the hole 5 of which receives the stub 21, which ensures a perfect angular locking, then the cap 22 is tightened, the notches 24 of which corresponding with the stub 6.

Figure 5:
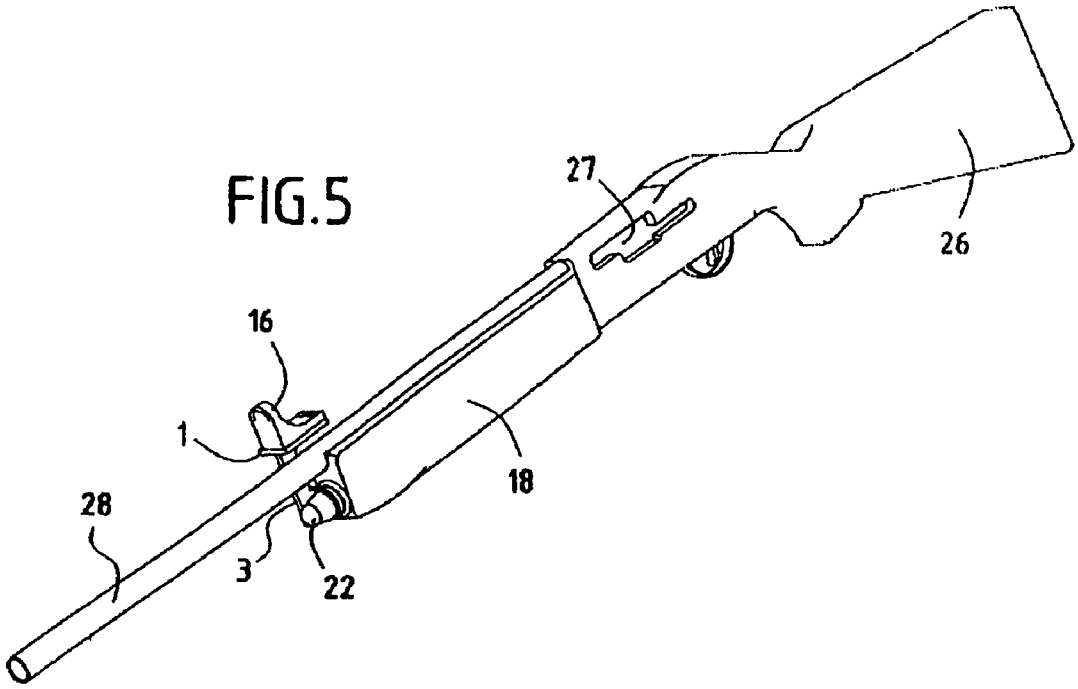
FIG. 5 is an elevated view of a gun equipped with a sight system fixed by means of the mounting according to the invention.

In FIG. 5 a semiautomatic hunting rifle is shown with a butt 26, a breech box 27 and a barrel 28. It can be seen that the sight 16 is situated above the barrel 28 in the axis of the sight of the gun.

Of course, the invention is not restricted to the embodiment described above and illustrated. It is possible to add numerous modifications to detail without departing from the scope of the invention.

What is claimed is:

1. A shotgun comprising a barrel and a magazine mounting in a housing having a threaded extension, a threaded securing cap engaging said threaded extension and having a collar including peripheral notches, a sight mounting means for supporting a sight device on the shotgun, said sight mounting means including a ring through which the threaded extension passes to mount the sight mounting means to the shotgun, the ring also including a ring stub cooperating with the notches of the notched collar to inhibit movement when the cap engages the threaded extension.

2. The shotgun of claim 1, wherein said ring includes a central bore through which said threaded extension passes.

3. The shotgun of claim 2, wherein said housing includes a housing stub and said ring further includes a stub hole for receiving said housing stub.

4. The shotgun of claim 1, wherein said sight mounting means comprises a tab extending between said ring and a small plate extending over said barrel for engaging said sight device, and said ring, tab and small plate are spaced from said barrel.

5. The shotgun of claim 4, wherein said small plate and said ring extend in perpendicular planes.

6. The shotgun of claim 4, wherein said magazine is fixed below said barrel and said threaded extension is parallel to said barrel.

7. The shotgun of claim 4, wherein said ring stub is resiliently mounted to said ring.

8. A shotgun comprising a barrel and a magazine mounting in a housing having a threaded extension receiving a threaded securing cap having a notched collar, a first elastic stub at the end of the housing, a support with a ring, the ring including a hole receiving the first stub, and a second elastic stub cooperating with the notches of the collar, the ring further including a tab having an end extending to a plate bent such that the plate bends over the barrel, the support further including means for securing a sight device onto the plate.

9. A shotgun as in claim 8, wherein said ring, tab and plate are spaced from said barrel.

10. Sight mounting means for mounting a sight device on a shotgun having a magazine mounting in a housing including a threaded extension, said sight mounting means comprising a ring plate having a central bore for receiving said threaded extension, a ring stub protruding from said ring plate, a tab extending from said ring plate to a small plate for supporting said sight device, said tab linking said ring plate and said small plate.

11. The sight mounting means of claim 10, wherein said small plate and ring plate respectively extend in perpendicular planes.

12. The sight mounting means of claim 11, wherein said shotgun includes a barrel and said ring plate, tab and small plate are spaced from said barrel.

13. The sight mounting means of claim 10, wherein said shotgun further includes a threaded securing cap received on said threaded extension and having a collar with peripheral notches, and said ring stub is engaged within said notches.

14. The sight mounting means of claim 10, wherein said sight device is a holographic sight device.

* * * * *